US007322425B2

(12) United States Patent
Keskiniva et al.

(10) Patent No.: US 7,322,425 B2
(45) Date of Patent: Jan. 29, 2008

(54) METHOD OF GENERATING STRESS PULSE IN TOOL BY MEANS OF PRESSURE FLUID OPERATED IMPACT DEVICE, AND IMPACT DEVICE

(75) Inventors: Markku Keskiniva, Tampere (FI); Jorma Mäki, Mutala (FI); Mauri Esko, Ikaalinen (FI); Erkki Ahola, Kangasala (FI); Aimo Helin, Tampere (FI); Timo Muuttonen, Siuro (FI)

(73) Assignee: Sandvik Mining and Construction Oy, Tampere (FI)

( * ) Notice: Subject to any disclaimer, the term of this patent is extended or adjusted under 35 U.S.C. 154(b) by 74 days.

(21) Appl. No.: 10/563,827

(22) PCT Filed: Jul. 6, 2004

(86) PCT No.: PCT/FI2004/000428

§ 371 (c)(1),
(2), (4) Date: Jan. 6, 2006

(87) PCT Pub. No.: WO2005/002801

PCT Pub. Date: Jan. 13, 2005

(65) Prior Publication Data

US 2006/0185864 A1 Aug. 24, 2006

(30) Foreign Application Priority Data

Jul. 7, 2003 (FI) ..... 20031036

(51) Int. Cl.
*B25D 9/06* (2006.01)

(52) U.S. Cl. ..... 173/1; 173/4; 173/11; 173/200; 173/206; 173/212

(58) Field of Classification Search ..... 173/4, 173/11, 14, 200, 201, 206, 207, 1, 2, 212, 173/210; 175/135, 189, 56, 298
See application file for complete search history.

(56) References Cited

U.S. PATENT DOCUMENTS 3,583,498 A * 6/1971 Dorm ..... 173/204
3,670,826 A * 6/1972 Hanson et al. ..... 173/4
3,971,217 A 7/1976 Firth et al.
4,159,039 A * 6/1979 Kasuga et al. ..... 173/1
4,484,638 A 11/1984 West
4,699,223 A * 10/1987 Noren ..... 175/40

(Continued)

FOREIGN PATENT DOCUMENTS

FI 20011434 A 1/2003

(Continued)

*Primary Examiner*—Scott A. Smith
(74) *Attorney, Agent, or Firm*—Drinker Biddle & Reath LLP

(57) ABSTRACT

A method of generating a stress pulse, and an impact device. In the method, pressure fluid is fed as pressure pulses to a working chamber residing between the frame of the impact device and a tool such that the resulting force presses the tool towards the material to be processed. The impact device comprises a working chamber and device for conveying pressure fluid as pressure pulses thereto such that a force is produced between the frame of the impact device and a tool to press the tool towards the material to be processed.

32 Claims, 3 Drawing Sheets

U.S. PATENT DOCUMENTS

| | | | | |
|---|---|---|---|---|
| 4,930,584 | A * | 6/1990 | Chaur Ching et al. | 173/200 |
| 5,351,763 | A * | 10/1994 | Muuttonen | 173/210 |
| 5,479,996 | A * | 1/1996 | Jonsson et al. | 175/135 |
| 5,592,866 | A | 1/1997 | Sher | |
| 6,029,753 | A * | 2/2000 | Kuusento et al. | 173/1 |
| 6,186,246 | B1 * | 2/2001 | Muuttonen et al. | 173/1 |
| 6,209,661 | B1 * | 4/2001 | Muona | 175/25 |
| 6,318,478 | B1 * | 11/2001 | Kaneko | 173/4 |
| 7,013,996 | B2 * | 3/2006 | Keskiniva et al. | 175/135 |
| 7,032,684 | B2 * | 4/2006 | Muuttonen et al. | 173/4 |

FOREIGN PATENT DOCUMENTS

| | | | |
|---|---|---|---|
| GB | 191504350 | A | 3/1915 |
| GB | 2190147 | A | 11/1987 |
| WO | 03004822 | A1 | 1/2003 |

* cited by examiner

METHOD OF GENERATING STRESS PULSE IN TOOL BY MEANS OF PRESSURE FLUID OPERATED IMPACT DEVICE, AND IMPACT DEVICE

FIELD OF THE INVENTION

The invention relates to a method of generating a stress pulse in a tool by means of a pressure fluid operated impact device, a rock drill or a braker in particular, in which method the tool is arranged to be in contact with the material to be struck in order to produce an impact in the material to be processed, and pressure fluid is fed to the impact device and discharged therefrom in order to use the impact device. The invention further relates to a pressure fluid operated impact device, a rock drill or a braker in particular, comprising a frame whereto a tool is mountable movably in its longitudinal direction, the tool, during an impact, being arranged to be in contact with the material to be struck, and means for feeding pressure fluid to the impact device and discharging pressure fluid therefrom in order to use the impact device.

BACKGROUND OF THE INVENTION

In prior art impact devices, a stroke is generated by means of a reciprocating percussion piston, which is typically driven hydraulically or pneumatically and in some cases electrically or by means of a combustion engine. A stress pulse is generated in a tool, such as a drill rod, when the percussion piston strikes an impact surface of either a shank or a tool.

A problem with the prior art impact devices is that the reciprocating movement of the percussion piston produces dynamic accelerating forces that complicate control of the apparatus. As the percussion piston accelerates in the direction of impact, the frame of an impact device tends to simultaneously move in the opposite direction, thus reducing the compressive force of the end of the drill bit or the tool with respect to the material like, for instance, rock to be processed. In order to maintain a sufficiently high compressive force of the drill bit or the tool against the material to be processed, the impact device must be pushed sufficiently strongly towards the material. This, in turn, requires the additional force to be taken into account in the supporting and other structures of the impact device, wherefore the apparatus will become larger and heavier and more expensive to manufacture. Due to its mass, the percussion piston is slow, which restricts the reciprocating frequency of the percussion piston and thus the striking frequency, although it should be significantly increased in order to improve the efficiency of the impact device. However, in the present solutions this results in far lower efficiency, wherefore in practice it is not possible to increase the frequency of the impact device.

BRIEF DESCRIPTION OF THE INVENTION

An object of the present invention is to provide a method of generating a stress pulse so as to enable drawbacks of dynamic forces caused by the operation of an impact device to be smaller than those in the known solutions.

The method according the invention is characterized in that in the impact device, pressure fluid is fed as pressure pulses to a working chamber residing in the impact device between a frame of the impact device and the tool such that the pressure of the pressure fluid produces a force between the frame of the impact device and the tool, the force pressing the tool towards the material to be processed such that due to the influence of the force, a stress pulse is generated in the tool in its longitudinal direction such that the stress pulse propagates through the tool to the material to be processed, the generation of the stress pulse ending substantially at the same time as the influence of the force on the tool ends.

The impact device according to the invention is characterized in that the impact device comprises a working chamber and means for conveying pressure fluid as pressure pulses to the working chamber such that the pressure of the pressure fluid produces a force between the frame of the impact device and the tool, the force pressing the tool towards the material to be processed such that due to the influence of the force, a stress pulse is generated in the tool in its longitudinal direction such that the stress pulse propagates through the tool to the material to be processed, the generation of the stress pulse ending substantially at the same time as the influence of the force on the tool ends.

The idea underlying the invention is that a stress pulse is generated directly by means of a pressure pulse compressing the tool and acting between the impact device, a rock drill or a braker in particular, and the tool, so that as a result of the tool being compressed, a stress pulse is generated substantially simultaneously with and similar in length to the pressure pulse.

An advantage of the invention is that the impulse-like impact movement thus generated does not necessitate a reciprocating percussion piston which generates a stress pulse by means of its kinetic energy. Consequently, as a result of the invention, no large masses are moved back and forth and the dynamic forces are small as compared with the dynamic forces of the reciprocating, heavy percussion pistons of the known solutions. A further advantage of the invention is that it is simple, and thus easy, to implement. Yet another advantage of the invention is that the operation of the impact device is easy to adjust in order to achieve impact performance as desired.

BRIEF DESCRIPTION OF THE DRAWINGS

The invention is described in closer detail in the accompanying drawings, in which FIG. 1 schematically shows an operating principle of an impact device suitable for implementing a method according to the invention, FIG. 2 schematically shows a second embodiment of an impact device suitable for implementing the method according to the invention, FIG. 3 schematically shows a third embodiment of an impact device suitable for implementing the method according to the invention, FIG. 4 schematically shows pressure and stress pulses occurring in the impact device and generated in accordance with the method according to the invention, FIG. 5 schematically shows an embodiment of an impact device according to the invention, and FIG. 6 schematically shows a fifth embodiment of an impact device according to the invention.

DETAILED DESCRIPTION OF THE INVENTION

Figure 1:
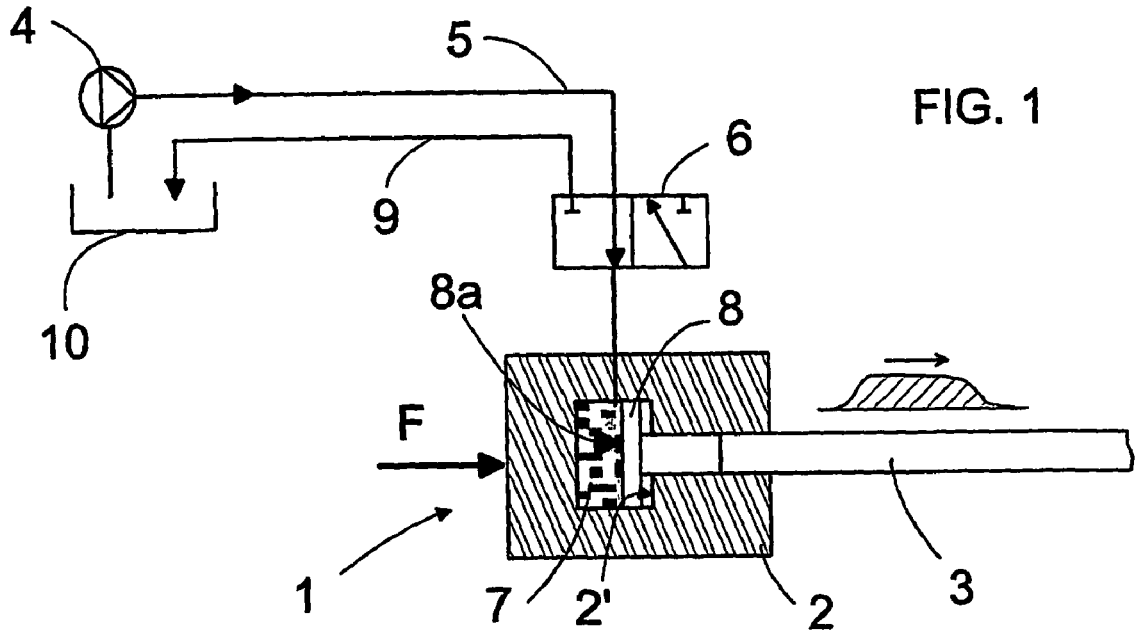

In FIGS. 1 to 6, like reference numerals identify like components, and their operation and properties will be repeated in the figures only when necessary for the understanding thereof.

FIG. 1 schematically shows an operating principle of an impact device suitable for implementing a method according to the invention. The figure shows an impact device 1 and its frame 2, and at one end of the frame a tool 3 which in its longitudinal direction is movably mounted with respect to the impact device 1. In order for the impact device to be used, pressure fluid is fed thereto by means of a pressure fluid pump 4 operating as a pressure source via a pressure fluid inlet channel 5. The pressure fluid inlet channel 5 is coupled to a control valve 6, which controls the pressure fluid feed to a working chamber 7. In the working chamber 7, a transmission piston 8 resides between the working chamber and the tool 3, the transmission piston being able to move in the axial direction of the tool 3 with respect to the frame 2. The transmission piston 8 may be a unit separate from the tool, but in some cases it may also be an integral part of the tool 3.

When being used, the impact device is pushed forward by a force F such that an end of the tool 3 is, directly or via a separate connecting piece, such as a shank or the like known per se, firmly pressed against the transmission piston 8 at least during the generation of a stress pulse. Consequently, the transmission piston 8 may first have almost no contact with the tool, as long as it substantially immediately at the outset of the generation of the stress pulse starts influencing the tool. At the same time, the tool 3 is in contact with the material to be struck (not shown), such as rock to be broken. In such a situation, pressure fluid, by means of the control valve 6, is allowed to quickly flow to the working chamber 7 to influence a pressure surface 8*a* of the transmission piston 8 facing away from the tool in its axial direction. A sudden stream of the pressurized pressure fluid to the working chamber 7 generates a pressure pulse, and a resulting force makes the transmission piston 8 to be pushed towards the tool 3 and the tool to become compressed in its longitudinal direction. As a result, a stress wave is generated in the drill rod or some other tool, and in propagating to the tool end, such as a drill bit, the wave produces an impact in the material to be processed, similarly as in the prior art impact devices. After a stress pulse of a desired length has been generated, the pressure fluid feed to the working chamber 7 is stopped by means of the control valve 6, whereby the generation of the stress pulse ends. Subsequently, pressure fluid is allowed to flow from the working chamber 7 via a return channel 9 to a pressure fluid tank 10, enabling the transmission piston to return to substantially the same the position it had prior to the generation of the stress pulse. The lengths in terms of time of the pressure pulse generated in the working chamber as well as of the resulting force and, correspondingly, of the stress pulse generated in the tool are substantially the same and they are generated substantially simultaneously. Adjusting the length and pressure of the pressure pulse of the pressure fluid enables the length and strength of the stress pulse to be adjusted. The impact properties of the impact device may further be adjusted by adjusting the time between pulses and/or feed frequency of the pulses.

The influence of the force produced in the tool 3 by the transmission piston 8 may also be ended in ways other than by stopping the pressure fluid feed to the working chamber 7. This may be implemented e.g. such that the movement of the transmission piston 8 is stopped against a shoulder 2', in which case the pressure acting behind the transmission piston 8 is no longer capable of pushing it towards the tool 3 with respect to the frame 2. Also in this embodiment, pressure fluid is allowed to flow from the working chamber 7 via the return channel 9 to the pressure fluid tank 10 so that the transmission piston 8 may return to its original position.

Figure 2:
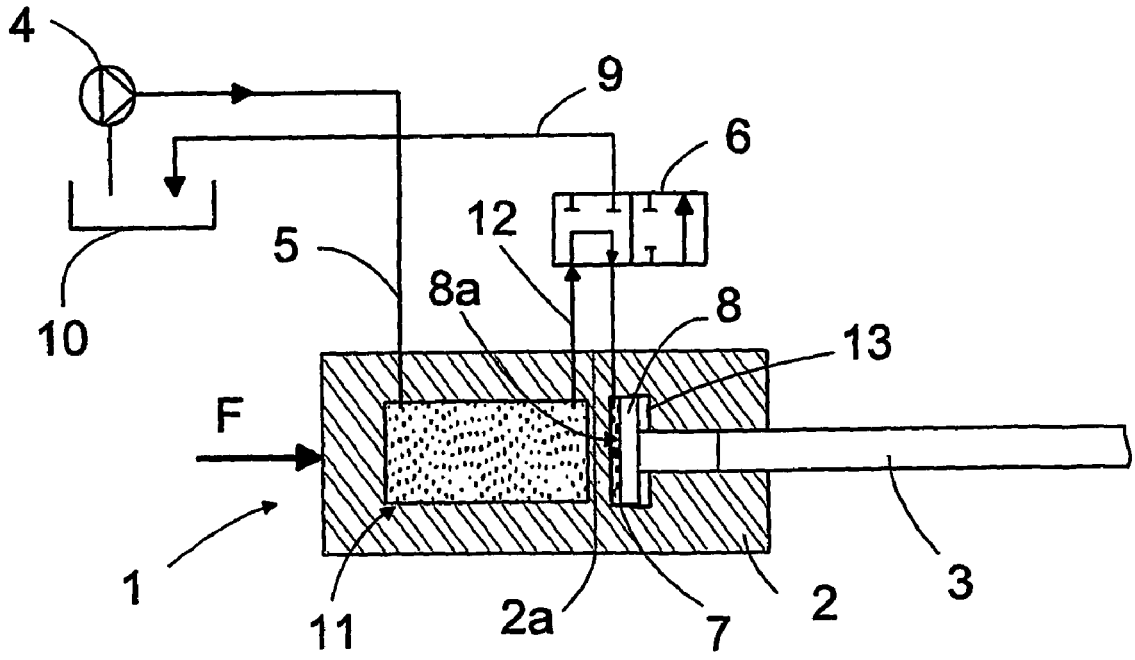

FIG. 2 schematically shows another embodiment of an impact device suitable for implementing the method according to the invention. In this embodiment, the impact device comprises an energy charging space 11, which may be located inside the frame 2 or it may be a separate pressure fluid tank attached thereto. This alternative is illustrated in broken line 2*a*, designating a possible joint between a separate frame and a pressure fluid tank. The energy charging space 11 is entirely filled with pressure fluid. When the impact device is in operation, pressure fluid is fed to the energy charging space 11 continuously by means of a pressure fluid pump 4 via a pressure fluid inlet channel 5. By means of a feed channel 12, the energy charging space 11 is further coupled to a control valve 6, which controls pressure fluid feed to the working chamber 7. The volume of the energy charging space 11 has to be substantially larger than the volume of the pressure fluid amount to be fed to the working chamber in one go during the generation of one stress pulse, preferably at least approximately 5 to 10 times as large. This is due to the fact that the larger the ratio between the volumes, the more even the feed pressure during pressure fluid feed, i.e. the pressure of the pressure pulse acting in the working chamber. This is because discharge of a small amount of fluid from a large volume decreases the pressure in the space in question only to a small extent.

When being used, the impact device is e.g. pushed forward such that an end of the tool 3 is, directly or via a separate connecting piece, such as a shank or the like, firmly pressed against the transmission piston 8 so that the other end of the tool 3 is in contact with the material to be struck. In this situation, by means of the control valve 6, pressure fluid is allowed to quickly flow from the energy charging space 11 to the working chamber 7 to influence a pressure surface 8*a* of the transmission piston 8 facing away from the tool in its axial direction. A sudden stream of the pressurized pressure fluid from the energy charging space 11 to the working chamber 7 generates a pressure pulse and, further, makes the transmission piston 8 to be pushed towards the tool 3 and the tool 3 to become compressed in its longitudinal direction, thus generating a stress pulse which propagates through the tool, as explained in connection with FIG. 1. After the stress pulse of the desired length has been generated, the pressure fluid flow from the energy charging space 11 to the working chamber 7 is cut off by means of the control valve 6 and the pressure fluid is allowed to flow from the working chamber 7 via the return channel 9 to the pressure fluid tank 10. FIG. 2 further shows a space 13 residing between the transmission piston 8 and the frame 2 of the impact device facing the tool 3 away from the transmission piston 8. In order to push the transmission piston back, when necessary, after generating a stress pulse, a pressure medium, such as a pressure fluid or pressurized gas or a gas mixture, may be fed to the space 13. The space may also be a sealed space filled with gas so that when a stress pulse is generated, the transmission piston 8 moves in the direction of the tool 3 and the gas becomes compressed to some extent. The pressure of the compressed gas, in turn, pushes the transmission piston 8 back when pressure fluid is discharged from the working chamber 7.

Figure 3:
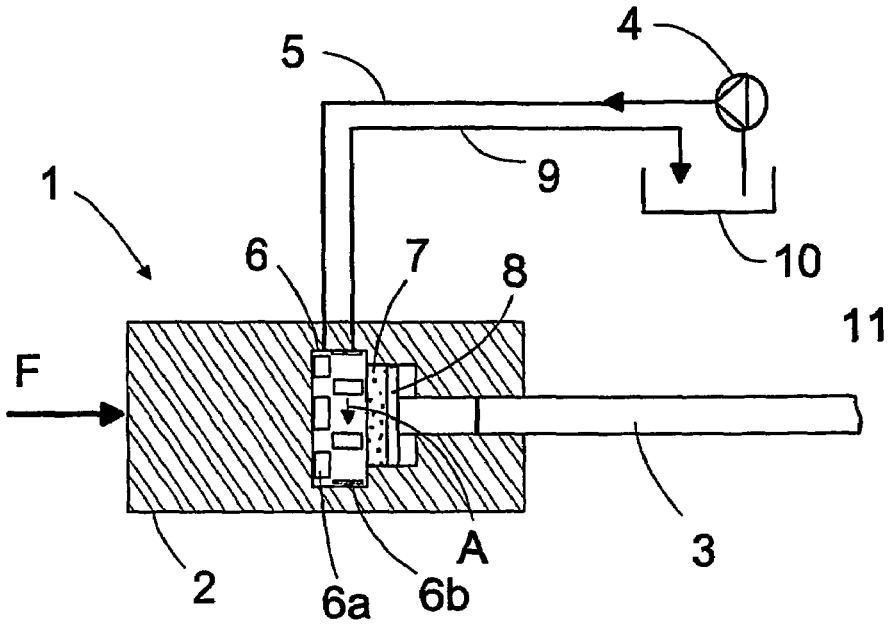

FIG. 3 schematically shows a third embodiment of an impact device suitable for implementing the method according to the invention. It comprises an impact device 1 comprising a frame 2 and a tool 3 mounted thereto. Coaxially with the tool 3 resides a rotatably mounted control valve 6 which is rotated around its axis by means of a suitable rotating mechanism, or turned rotatingly back and forth. From the pressure fluid pump 4, a pressure fluid feed channel 5 leads preferably at a plurality of openings 6*a* which serve as control channels for the valve 6 and which by way of example pass through the valve 6, so that the openings 6*a*, one by one or simultaneously, come at the pressure fluid feed channel 5 or channels connected thereto and allow the pressure fluid to flow to the working chamber 7, thus pushing the piston 8 towards the tool 3. As a result, a stress pulse is generated as the tool 3 becomes compressed. Similarly, when the rotating valve 6 rotates forward as indicated by arrow A, discharge openings 6*b* located alternately with the openings 6*a* and also serving as pressure fluid channels and by way of example passing through the valve 6 come, one by one or simultaneously, at the pressure fluid discharge channel 9 or channels connected thereto, so that pressure fluid is allowed to quickly flow from the working chamber 7 to the pressure fluid tank 10. As a result, the pressure in the working chamber 7, in turn, decreases, and the generation of the stress pulse in the tool 3 ends. Instead of different feed and discharge openings 6*a* and 6*b*, successive openings residing only at one point of the circumference of the valve in the direction of the circumference may be used via which openings pressure fluid is alternately allowed to flow to the working chamber 7 and, correspondingly, when the valve 6 rotates and the openings move to another point in the direction of rotation, pressure fluid is discharged from the working chamber via the same openings to the discharge channel 9.

Figure 4:
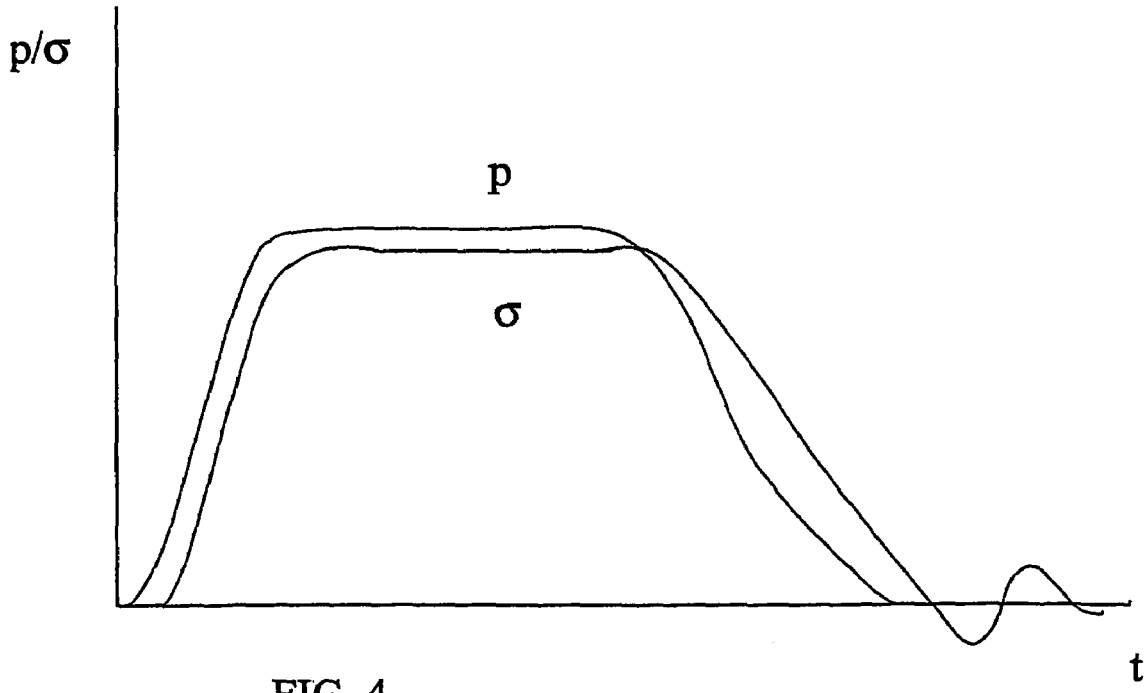

FIG. 4 schematically shows a shape and strength of pressure and stress pulses generated in accordance with the invention. A pressure pulse p starts to form when the control valve 6 opens the pressure fluid flow to the working chamber 7. Similarly, a stress pulse σ starts to form almost simultaneously. As can be seen in FIG. 4, the pressure pulse p and the stress pulse σ are substantially simultaneous and similar in length, although a small delay occurs between the pressure increase and the generation of the stress pulse. The length of the stress pulse may thus be adjusted by adjusting the length of the pressure pulse and, correspondingly, the amplitude of the stress pulse by adjusting the amplitude of the pressure pulse. When, in addition, it is possible to adjust the time and frequency between pulses, it is in many ways simple and easy to control the impact device and adjust the impact performance according to the invention.

Figure 5:
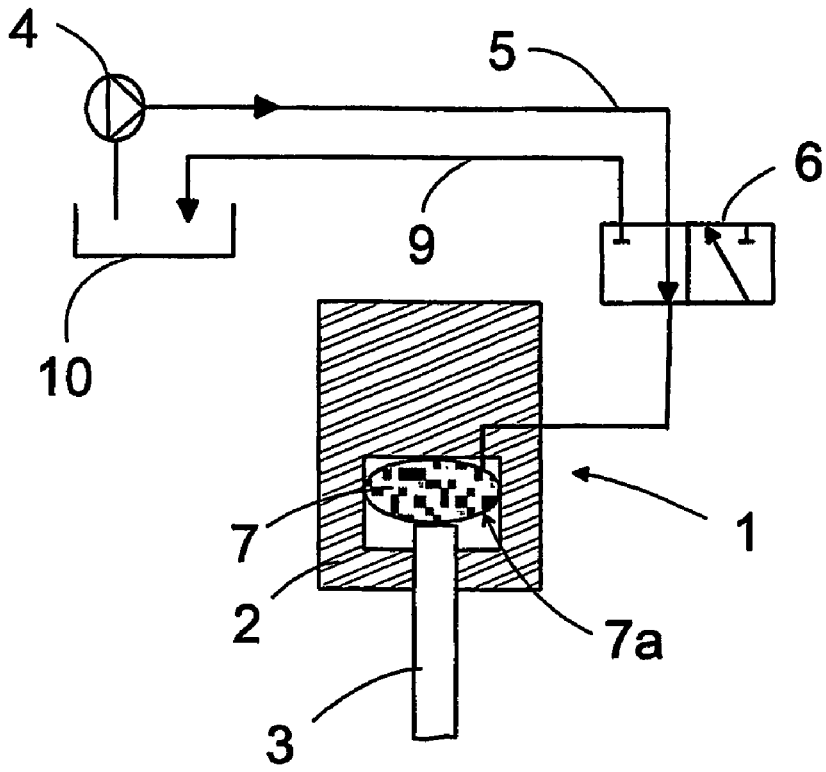

FIG. 5 schematically shows a fourth embodiment of an impact device according to the invention. In this embodiment, a working chamber 7 of an impact device 1 consists of a separate pressure chamber 7*a* whereto pressure fluid is conveyed in order to generate a stress pulse. The shape of the chamber 7*a* is such that when pressure fluid flows to a working chamber 7 therein, the shape of the chamber 7*a* changes such that its dimension increases in the axial direction of a tool 3. When the tool 3 has been arranged against the chamber 7*a* either directly as shown in FIG. 5 or through a connecting element or a connecting piece as shown previously, the change in the length of the chamber 7*a* makes the tool 3 to compress such that a stress pulse is generated as described above. Similarly, when pressure fluid is discharged from the chamber 7*a*, the dimension of the chamber 7*a* decreases in the axial direction of the tool 3*a*, and the stress pulse ends. In the embodiment shown in FIG. 5, the shape of the chamber 7*a* is somewhat flat, in which case its dimension in thickness changes when the pressure fluid presses its outer surface into a more circular shape. Similarly, also other technical embodiments wherein some dimension of a chamber changes due to the influence of pressure are also feasible.

Figure 6:
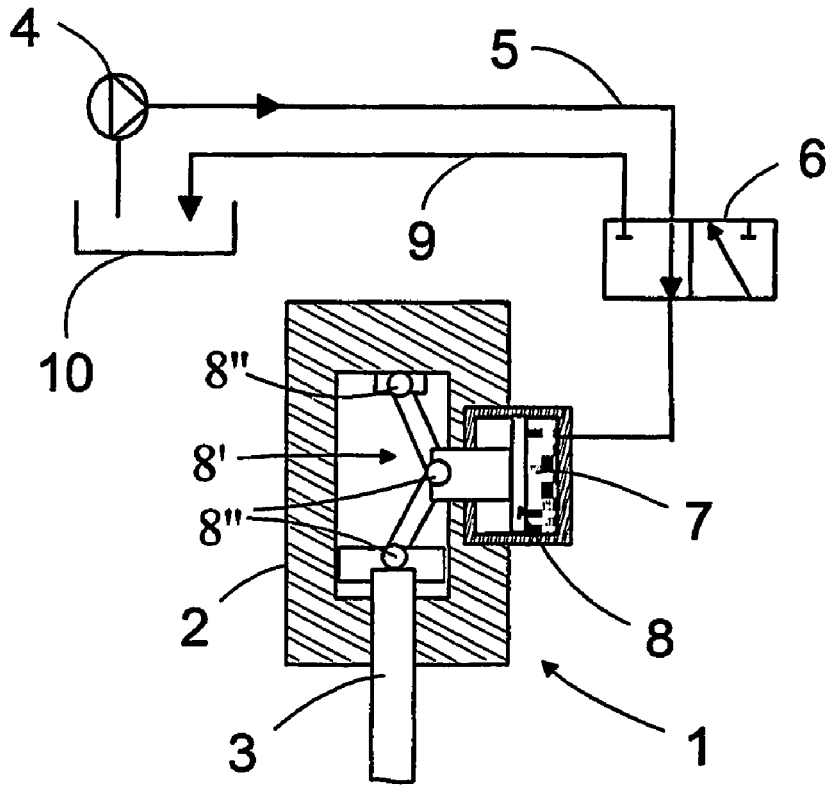

FIG. 6 shows a fifth embodiment of an impact device according to the invention. In order to generate a stress pulse in an impact device 1, in addition to a working chamber 7 and a transmission piston 8, this embodiment employs a separate transmission element 8' which by way of example is shown as a joint mechanism. In this embodiment, the joint mechanism is at its one end and by means of joints 8" coupled to be supported against the frame 2 of the impact device and, at its other end to be in contact with a tool 3. The middle joint 8" of the joint mechanism, in turn, is coupled to the transmission piston 8.

When pressure fluid is fed to the working chamber 7, the transmission piston 8, in the situation shown in FIG. 6, is pushed to the left in the transverse direction of the tool 3, in which case the joint mechanism straightens and, consequently, the distance between the extreme joints 8" grows. The result is that the tool 3 is being compressed and, due to the influence of a pressure pulse, a stress pulse is generated as described above. Similarly, when the transmission piston 8 returns when pressure fluid is discharged from the working chamber 7, the distance between the extreme joints 8" is reduced, and the tool 3 is allowed to return to its original position.

In all embodiments of the invention it is, of course, clear that in order to provide a continuous impacting operation, the tool 3 has to be returned to its substantially pre-impact position with respect to the impact device. In certain situations, designated e.g. by FIGS. 5 and 6, the return may take place entirely due to the influence of the impact device's own weight and gravity. Similarly in these situations, due to the influence of gravity, the tool's end is often located against the material to be struck. On the other hand, in situations wherein the operational position of the impact device differs from an upright and downwards striking one, various means which move the tool with respect to the frame of the impact device have to be used for returning the tool. Such means for producing a force acting between a separate impact device and a tool may be e.g. a separate chamber 13 on the side of the transmission piston 8 facing the tool 3 as described in FIG. 2, whereto pressure fluid or pressurized gas may be fed or which may already contain pressurized gas which pushes the transmission piston back to a position wherein a stress pulse is to be generated therein. Thus, this pressure medium acting in the chamber produces a force acting between the frame of the impact device and the tool. In solutions wherein the transmission piston 8 is an integrated part of the tool 3, the tool naturally moves along with the transmission piston. Similarly, in these situations, the impact device has to be pushed towards the material to be processed in a manner known per se, either manually or by using different booms, feed beams or other structures known per se.

In the disclosed embodiments, the invention has only been shown schematically; similarly, the valves and couplings relating to pressure fluid feed have also been shown schematically. The invention may be implemented using any suitable valve solutions. The point is that in order to generate a stress pulse, pressure fluid is fed to a working chamber at suitable intervals and as pressure pulses to influence a pressure surface of a transmission piston in order to achieve a desired impact frequency so as to produce a force which compresses the tool in its longitudinal direction so that a stress pulse is generated in the tool, the stress pulse propagating through the tool to the material to be processed.

The invention claimed is:

1. A method of generating a stress pulse in a tool by means of a pressure fluid operated impact device, a rock drill or a braker, comprising:

arranging the tool to be in contact with the material to be struck in order to produce an impact in the material to be processed;

feeding pressure fluid to the impact device and discharging the pressure fluid therefrom in order to use the impact device;

feeding pressure fluid as pressure pulses to a working chamber residing in the impact device between a frame of the impact device and the tool such that the pressure of the pressure fluid produces a force between the frame of the impact device and the tool, the force pressing the tool towards the material to be processed such that due to the influence of the force; and generating a stress pulse in the tool in its longitudinal direction such that the stress pulse propagates through the tool to the material to be processed, the generation of the stress pulse ending substantially at the same time as the influence of the force on the tool ends.

2. A method as claimed in claim 1, wherein the stress pulse is substantially simultaneous with and similar in length to the influence of the force on the tool.

3. A method as claimed in claim 1, wherein the force produced by the pressure pulses is transmitted to the tool by means of a separate transmission piston residing between the working chamber and the tool.

4. A method as claimed in claim 1, wherein the length of the stress pulse is adjusted by adjusting the length of the pressure pulse.

5. A method as claimed in claim 1, wherein the amplitude of the stress pulse is adjusted by adjusting the amplitude of the pressure pulse.

6. A method as claimed in claim 1, wherein the frequency of the stress pulses is adjusted by adjusting the feed frequency of the pressure pulses.

7. A method as claimed in claim 1, wherein after an impact, the tool is returned to its pre-impact position with respect to the impact device by pushing the impact device towards the tool.

8. A method as claimed in claim 1, wherein after an impact, the tool is returned to its pre-impact position with respect to the impact device by bringing a separate force acting between the impact device and the tool to influence the tool, the force pushing the tool towards the impact device.

9. A method as claimed in claim 8, wherein the separate force acting between the impact device and the tool is produced by means of a pressure medium acting in a chamber residing between the frame of the impact device and the tool.

10. A method as claimed in claim 1, wherein in order to produce a pressure pulse, energy is charged in an energy charging space provided in the impact device and operating as an energy charging means and filled entirely with pressurized pressure fluid, the volume of the energy charging space being substantially large as compared with the volume of a pressure fluid amount to be fed in one go to the working chamber during one pressure pulse.

11. A method as claimed in claim 10, wherein when the impact device is in operation, pressure fluid is fed to the energy charging space continuously, and that pressure fluid is discharged from the energy charging space periodically alternately to the working chamber and, correspondingly, the connection from the energy charging space to the working chamber is closed and the connection from the working chamber to a pressure fluid discharge channel is opened.

12. A method as claimed in claim 1, wherein the pressure fluid feed is controlled by a control valve.

13. A method as claimed in claim 12, wherein the control valve is a rotating valve provided with a plurality of successive openings in its direction of rotation to feed pressure fluid via a plurality of feed channels to the working chamber simultaneously.

14. A method as claimed in claim 12, wherein the control valve is a rotating valve provided with a plurality of successive openings in its direction of rotation to feed pressure fluid via a plurality of feed channels to the working chamber simultaneously, and to discharge pressure fluid from the working chamber.

15. A method as claimed in claim 12, wherein the control valve is a rotating valve provided with a plurality of successive openings in its direction of rotation to feed pressure fluid via a plurality of feed channels to the working chamber simultaneously and, correspondingly, a plurality of successive openings in its direction of rotation to discharge pressure fluid from the working chamber.

16. A pressure fluid operated impact device, a rock drill or a braker, comprising:

a frame whereto a tool is mountable movably in its longitudinal direction, the tool, during an impact, being arranged to be in contact with the material to be struck;

means for feeding pressure fluid to the impact device and discharging pressure fluid therefrom in order to use the impact device;

wherein the impact device comprises a working chamber and means for conveying pressure fluid as pressure pulses to the working chamber such that the pressure of the pressure fluid produces a force between the frame of the impact device and the tool, the force pressing the tool towards the material to be processed such that due to the influence of the force, a stress pulse is generated in the tool in its longitudinal direction such that the stress pulse propagates through the tool to the material to be processed, the generation of the stress pulse ending substantially at the same time as the influence of the force on the tool ends.

17. An impact device as claimed in claim 16, wherein the stress pulse in the tool is substantially simultaneous with and similar in length to the influence of the force on the tool.

18. An impact device as claimed in claim 16, wherein the working chamber resides between the frame of the impact device and the tool.

19. An impact device as claimed in claim 16, wherein the impact device comprises a transmission piston which moves in the working chamber, the transmission piston being provided with a pressure surface which resides towards the working chamber and which the pressure of the pressure fluid influences, and that the transmission piston is directly or indirectly in contact with the tool such that when the transmission piston moves, the transmission piston produces a force acting between the frame of the impact device and the tool.

20. An impact device as claimed in claim 19, wherein the transmission piston moves in the axial direction of the tool.

21. An impact device as claimed in claim 16, wherein the means for feeding and discharging pressure fluid comprise an energy charging space which contains pressurized pressure fluid and whose volume is substantially large as compared with the volume of the working chamber.

22. An impact device as claimed in claim 21, wherein when the impact device is in operation, the means for feeding pressure fluid to the impact device and for discharging pressure fluid therefrom allow pressure fluid to flow to the energy charging space continuously, and periodically alternately open the connection from the energy charging space to the working chamber and, correspondingly, close the connection from the energy charging space to the working chamber and open the connection from the working chamber to a pressure fluid discharge channel.

23. An impact device as claimed in claim 16, wherein the means for feeding and discharging pressure fluid comprise a control valve.

24. An impact device as claimed in claim 23, wherein the control valve is arranged to control pressure fluid feed to the working chamber periodically.

25. An impact device as claimed in claim 24, wherein the control valve is a rotating valve provided with a plurality of successive openings in its direction of rotation to feed pressure fluid therethrough to the working chamber simultaneously.

26. An impact device as claimed in claim 24, wherein the control valve is a rotating valve provided with a plurality of successive openings in its direction of rotation to feed pressure fluid therethrough to the working chamber simultaneously and, correspondingly, to discharge pressure fluid from the working chamber.

27. An impact device as claimed in claim 24, wherein the control valve is a rotating valve provided with a plurality of successive openings in its direction of rotation to feed pressure fluid therethrough to the working chamber simultaneously and, correspondingly, a plurality of successive openings in its direction of rotation to discharge pressure fluid therethrough from the working chamber simultaneously.

28. An impact device as claimed in claim 23, wherein the control valve is arranged to control pressure fluid discharge from the working chamber periodically.

29. An impact device as claimed in claim 23, wherein the control valve is a rotating valve.

30. An impact device as claimed in claim 16, wherein the impact device comprises means for returning a transmission piston or a tool after an impact to its substantially pre-impact position with respect to the impact device by pushing the impact device towards the tool.

31. An impact device as claimed in claim 16, wherein the impact device comprises means for returning a transmission piston or a tool after an impact to its substantially pre-impact position with respect to the impact device by bringing a separate force acting between the impact device and the tool to influence the tool, the force pushing the tool towards the impact device.

32. An impact device as claimed in claim 16, wherein the means for producing the force acting between the separate impact device and the tool comprise a chamber residing between the impact device and the tool, wherein the force is produced by means of a pressure medium therein or to be fed thereto.

* * * * *